US012653224B2

(12) United States Patent
Preusser et al.

(10) Patent No.: US 12,653,224 B2
(45) Date of Patent: Jun. 16, 2026

(54) FLAVORING DEVICE AND A METHOD TO FLAVOR AN AEROSOL GENERATING ARTICLE USING SUCH FLAVORING DEVICE

(71) Applicant: JT International SA, Geneva (CH)

(72) Inventors: Stephan Preusser, Trier (DE); Adrian Hartanto, Trier (DE); Daniel Lickefeld, Riol (DE)

(73) Assignee: JT International SA, Geneva (CH)

( * ) Notice: Subject to any disclaimer, the term of this patent is extended or adjusted under 35 U.S.C. 154(b) by 694 days.

(21) Appl. No.: 17/924,621

(22) PCT Filed: May 12, 2021

(86) PCT No.: PCT/EP2021/062598
§ 371 (c)(1),
(2) Date: Nov. 10, 2022

(87) PCT Pub. No.: WO2021/228926
PCT Pub. Date: Nov. 18, 2021

(65) Prior Publication Data

US 2023/0189874 A1 Jun. 22, 2023

(30) Foreign Application Priority Data

May 13, 2020 (EP) ..... 20174481

(51) Int. Cl.
*A24D 1/00* (2020.01)
*A24D 1/02* (2006.01)
(Continued)

(52) U.S. Cl.
CPC ..... *A24D 1/002* (2013.01); *A24D 1/02* (2013.01); *A24D 1/042* (2013.01); *A24D 1/20* (2020.01); *A24D 3/043* (2013.01); *A24D 3/18* (2013.01)

(58) Field of Classification Search
CPC . A24D 1/002; A24D 1/02; A24D 1/20; A24D 1/042; A24D 3/043; A24D 3/18; A24D 1/04; A24D 3/048
See application file for complete search history.

(56) References Cited

U.S. PATENT DOCUMENTS 4,082,098 A 4/1978 Owens, Jr.
5,080,114 A 1/1992 Rudolph et al.
(Continued)

FOREIGN PATENT DOCUMENTS

EP 3155909 A1 4/2017
GB 2496103 A 5/2013
(Continued)

OTHER PUBLICATIONS

International Search Report for Application No. PCT/EP2021/062598 mailed Aug. 18, 2021, pp. 1-4.

*Primary Examiner* — Michael H. Wilson
*Assistant Examiner* — Stephanie Lynn Moore
(74) *Attorney, Agent, or Firm* — Lerner David LLP

(57) ABSTRACT

A flavoring device includes a three-dimensional shape with a surface enclosing an inner volume, wherein the surface includes a first part directed outwardly of the three-dimensional shape and a second part being the lateral area of a cylindrically shaped hole protruding through the flavoring device, wherein the flavoring device includes a frame arranged at the surface of the three-dimensional shape and framing the inner volume at least in part, wherein the flavoring material is arranged within the frame, wherein the frame and the flavoring material are permeable to an air flow directed from a surrounding of the flavoring device through the first part of the surface, through the inner volume, thereby interacting with the flavoring material, and through the second part of the surface into the hole, in which the
(Continued)

smoking article is arrangeable. The device includes the shape of a hollow cylinder having airflow-permeable inner and outer lateral areas.

15 Claims, 8 Drawing Sheets

(51) Int. Cl.

| | |
|---|---|
| ***A24D 1/04*** | (2006.01) |
| ***A24D 1/20*** | (2020.01) |
| ***A24D 3/04*** | (2006.01) |
| ***A24D 3/18*** | (2006.01) |

(56) References Cited

U.S. PATENT DOCUMENTS

2008/0216850 A1* 9/2008 Li ..... A24D 1/04
131/187
2010/0108081 A1* 5/2010 Blevins Joyce ..... A24D 1/025
131/274
2020/0315257 A1* 10/2020 Rostami ..... A24B 15/167

FOREIGN PATENT DOCUMENTS

WO 2008110933 A2 9/2008
WO 2019166581 A1 9/2019

* cited by examiner

FLAVORING DEVICE AND A METHOD TO FLAVOR AN AEROSOL GENERATING ARTICLE USING SUCH FLAVORING DEVICE

CROSS-REFERENCE TO RELATED APPLICATIONS

The present application is a national phase entry under 35 U.S.C. § 371 of International Application No. PCT/EP2021/062598, filed May 12, 2021, published in English, which claims priority to European Application No. 20174481.0 filed May 13, 2020, the disclosures of which are in-corporated herein by reference.

FIELD OF THE INVENTION

The present invention relates to a flavoring device, with which a smoke and/or vapor of a smoking article is flavorable by interaction with a flavoring material.

BACKGROUND

Several technologies for flavoring the smoke or vapor of a smoking article such as breakable capsules, flavored tobacco or flavored e-liquids are available in the market. These technologies however comprise the disadvantage that a specific flavoring is either permanently comprised in the smoking article or at least not easily interchangeable.

It is therefore the objective of the invention to provide a flavoring device that allows the consumer to freely decide if the smoke or vapor should be flavored at all and, if that is the case, freely select the desired flavor.

SUMMARY

The afore mentioned drawbacks are eliminated by a flavoring device, with which a smoke and/or vapor of a smoking article is flavorable by interaction with a flavoring material, wherein the flavoring device comprises a three-dimensional shape with a surface enclosing an inner volume, wherein the surface comprises a first part directed outwardly of the three-dimensional shape and a second part being the lateral area of a cylindrically shaped hole protruding through the flavoring device, wherein the flavoring device comprises a frame arranged at the surface of the three-dimensional shape and framing the inner volume at least in part, wherein the flavoring material is arranged within the frame, wherein the frame and the flavoring material are permeable to an air flow directed from a surrounding of the flavoring device through the first part of the surface, through the inner volume, thereby interacting with the flavoring material, and through the second part of the surface into the hole, in which the smoking article is arrangeable. The flavoring device comprises the shape of a hollow cylinder having airflow permeable inner and outer lateral areas. In other words, the flavoring device comprises the shape of a ring with a rectangular cross-section.

The flavoring device is arrangeable on a smoking article, preferably on a filter part of the smoking article. Therefore, the diameter of the hole preferably matches the diameter of a smoking article. As the diameter of smoking articles is a standardized measure, the flavoring device will be arrangeable on most smoking articles. However, the flavoring device is not integrated into the smoking article. This implies, that the consumer can freely decide whether to arrange a flavoring device according to the invention on a smoking article for flavoring the smoke or vapor or not. Preferably, the flavoring device is offered in different types, wherein each type comprises a different type of flavoring material delivering a different flavor to the airflow. In this way, the consumer can decide which type of flavoring device to arrange on the smoking article and therefore which type of flavor should be delivered to the airflow.

The flavoring device delivers a flavor to the mainstream smoke of a smoking article to which it is attached. To do so, an airflow channel is present from the surrounding of the flavoring device through the first part of its surface and subsequently through its inner volume through the second part of its surface. When the flavoring device is arranged on a smoking article, the second part of its surface is in fluid communication with the mainstream airflow of the smoking article. This is preferably ensured by arranging the flavoring device covering ventilation holes of the smoking article. Preferably, these ventilation holes are ventilation holes in the tipping paper of a filter segment of a smoking article.

With the airflow permeable inner and outer lateral areas, the airflow through the flavoring device is ensured. Preferably, the first part of the surface is only airflow permeable in part. Preferably, this is realized by the airflow permeable outer lateral area in combination with airflow impermeable base areas of the hollow cylinder.

According to another embodiment in the inner volume a carrier material is arranged in which the flavoring material is contained. With the carrier material the flavoring material can be easily arranged in the flavoring device. Preferably, the carrier material absorbs the flavoring material, wherein it releases the flavoring material to the airflow at a controlled desorption rate. In this way, it is also possible to use a liquid flavoring material and contain it spill-free in the flavoring device.

According to another embodiment a diameter of the cylindrically shaped hole equals the diameter of a mouth piece of a smoking article. The diameter of the cylindrically shaped hole refers to the diameter of the cylindrical cross section of this hole. Typical mouthpieces of conventional smoking articles are slightly soft and squeezable. Often cellulose acetate is used as a material for such mouthpieces. By using the very same diameter of the mouthpiece also for the diameter of the cylindrically shaped hole, the mouthpiece must be compressed slightly when fitting the flavoring device on such a mouthpiece. In this way a tight and snug fit of the flavoring device on a smoking article is ensured.

According to another embodiment the first and second part of the surface comprise cut-outs, perforations and/or are netlike at least in part. Cut-outs, perforations and/or a netlike structure implies that the first and second part of the surface comprise holes protruding through the material of the surface completely and thereby providing a fluid communication between the surrounding of the flavoring device and its inner volume.

According to another embodiment the frame consists of cellulose acetate, at least one biodegradable polymer, wood, cork, clay and/or zeolite. These materials provide sufficient rigidity for stabilizing the flavoring device in its shape. Also these materials are natural materials. The use of natural materials provides advantages regarding the disposal of the flavoring device after its use given their recyclability.

According to another embodiment the flavoring material consists of a solid material, a crystal, a granule, a gel and/or a liquid. With a solid flavoring material, preferably a crystal and/or a granule, the flavoring material can be contained easily in the frame without further means. The airflow is then in contact with the surface of the solid flavoring material.

The solid flavoring material preferably comprises a porosity, or in the case of a crystal or granule material, a small crystal grain size or small granule sizes respectively, to increase the surface area of the solid flavoring material for an efficient transferal of flavor from the flavoring material to the airflow. With a gel or liquid flavoring material the range of possible flavoring materials is further ex-panded. Also a gel or liquid flavoring material comprises the advantage of being more easily transferrable to a passing-by airflow. Preferably, a liquid or gel flavoring material is combines with a carrier material. In this case, the flavoring material is adsorbed in the carrier material, preferably not exceeding the absorption capacity of the carrier material for the flavoring material.

According to another embodiment the carrier material consists out of clay, zeolite, cellulose, cellulose acetate, cotton, granule and/or gel. These materials provide sufficient absorption capacity for a flavoring material. Preferably, the carrier material is a natural material, which preferably is biodegradable.

According to another embodiment it comprises a peel-off strip covering at least all airflow permeable parts of the first part of the surface. As the strip is a peel-off strip, it is removable from the flavoring device. Before removal, the peel-off strip covers at least all airflow permeable parts of the first part of the surface. In this way, any airflow through the airflow permeable parts is blocked by the strip. This means that any airflow through the flavoring device is blocked as long as the strip covers at least all airflow-permeable parts of the first part of the surface. When the strip is removed, i.e. peeled off, the airflow becomes possible. Therefore the peel-off strip denotes a freshness seal preventing the flavoring material from exhaustion before the flavoring device is actually used by the consumer.

According to another embodiment the peel-off strip comprises paper and/or cellulose. Paper and/or cellulose are broadly available and cost effective materials. To even better maintain the freshness of the flavoring material by more efficiently blocking the airflow through the airflow-permeable parts, the paper and/or cellulose material may be coated with an air-impermeable material.

According to another embodiment the flavoring device comprises a gasket at edges of the second part of the surface. When the flavoring device is arranged on a smoking article, the gaskets rest sealingly against the smoking articles surface. This ensures, that any airflow through the smoking articles surface part covered by the flavoring device has previously passed the inner volume of the flavoring device.

In another embodiment, the flavoring device comprises advantageously a removable holder, for instance in a stick form, wherein the removable holder is made of non-porous material comprising a circular cross section with a diameter corresponding to the diameter of a base area of the cylindrically shaped hole of the flavoring device, which is placed on the removable holder with the removable holder arranged protruding through the hole.

The removable holder serves as a substitute for a smoking article to store the flavoring device before use. It is also thinkable to use the removable holder for storage of the flavoring device after use. Because the diameter of the circular cross section of the removable holder corresponds to the diameter of the base area of the cylindrically shaped hole, the flavoring device properly fits on the removable holder. Preferably, the diameter of the circular cross section of the removable holder is the same as the diameter of a smoking article. Preferably, the second part of the surface of the flavoring device is in full area contact with the surface of the removable holder. As the removable holder consists of a non-porous material, preferably impermeable to airflow, any airflow through the second part of the surface of the flavoring device is prohibited. In this way, no airflow is directed through the inner volume of the flavoring device and it can therefore be stored on the removable holder prior to usage maintaining the freshness of the flavoring material. Preferably, the removable holder is combined with the embodiment of the flavoring device comprising the peel-off strip. In this way, the air-permeable first part of the surface of the flavoring device is coated and sealed by the peel-off strip and the second part of the surface of the flavoring device rest against the air-impermeable removable holder. Even more preferred, this feature combination is further complemented by the gaskets at the edges of the second part of the surface. This further improves the sealing of the second part of the surface of the flavoring device so that the freshness of the flavoring material is secured even better. The removable holder also provides a convenient storage means for one or more the flavoring devices. The flavoring devices can be sold to the consumer on the removable holder. Besides the maintained freshness, this also allows to group a number of flavoring devices together. Preferably, the removable holder comprises a stick form.

The objective is also reached by a kit comprising a smoking article and a flavoring device according to at least one of the previously described embodiments, wherein the flavoring device is placed on a mouth piece of the smoking article with the mouth piece arranged protruding through the hole, wherein the mouthpiece comprises air intakes openings and the flavoring device is placed over the air intake openings with its second part of the surface and the airflow of the flavoring device is in fluid communication with the smoke and/or vapor through the air intake openings.

The smoking article shall be understood herein as any of a cigarette, cigarillo, cigar, heat-not-burn consumable, e-cigarette or the like of substantially an elongated format of regular cross-section, wherein air intake openings are provided in the article so as to allow an airflow to be drawn in the article in use to generate an inhalable vapor or smoke that can be inhaled by a user, in particular through a mouthpiece fluidly connected to the air intake openings. With the kit of the invention, a user can easily place the flavoring device about the article's air intakes openings in order to allow flavoring of a smoke or vapor on-demand. If the smoking article is a standard cigarette or cigarillo for example the flavoring device may be placed on a mouth piece of the smoking article with the mouth piece arranged protruding through the hole and the mouth piece comprises a cylindrical filter and a wrapper wrapped around a lateral area of the filter, wherein the wrapper comprises circumferentially arranged ventilation holes, which are in fluid communication with the smoke and/or vapor flowing along a longitudinal axis through the filter, and the flavoring device is placed over the ventilation holes with its second part of the surface and the airflow of the flavoring device is in fluid communication with the smoke and/or vapor through the ventilation holes.

In the case of a conventional cigarette, the air intake opening are standard ventilation holes in the wrapper, which create a second flow path from the surrounding of the smoking article through the ventilation holes into the filter of the smoking article where the second flow path unites with the primary flow path, which delivers smoke and/or vapor to the consumer's mouth. The second flow path ensures that the correct amount of the smoking article is used up per puff, e.g. in the case of a conventional cigarette, not too much tobacco or too little is burnt per puff. This means that the ventilation holes are present in conventional smoking articles. The flavoring device now uses this existing second flow path to introduce flavored air into the primary flow path. By placing the flavoring device on the smoking article covering the ventilation holes, the second flow path of the smoking article is first directed from the surrounding through the flavoring device as previously described and then from the second part of the surface of the flavoring device through the ventilation holes into the filter of the smoking article. From there the flavored air is delivered into the consumer's mouth together with the smoke and/or vapor. In this way, the consumer can easily flavor the smoke and/or vapor of a conventional smoking article in a convenient and individual way. It is also possible for the consumer to move the flavoring device away from the ventilation holes before a puff and back on the ventilation holes before any subsequent puff. In this way, an even higher degree of individualization regarding the flavor is possible, as the flavor of every puff can be set.

According to an embodiment the smoking article comprises a wrapper with two circumferential perforation lines distanced from each other along the longitudinal axis, wherein a circumferential first part of the wrapper enclosed between the perforation lines is removable from the mouth piece with respect to a second part of the wrapper. In this embodiment, the consumer removes the first part of the wrapper before arranging a flavoring device on the smoking article. The flavoring device is then arranged between the remaining parts of the wrapper, which denotes a second part of the wrapper. In this way, no wrapper is arranged at the second surface of the flavoring device. This means that the airflow coming out of the second part of the surface of the flavoring device does not need to pass through ventilation holes and the flavored air can better reach the primary flow path of the smoking article. If no flavoring device is arranged on the smoking article, the perforation lines may serve as ventilation holes for the smoking article, creating the necessary secondary flow path.

The objective is also reached by a method for flavoring smoke and/or vapor of a smoking article comprising a mouth piece with air intake openings. The method is characterized in that a flavoring device comprising:

- a three-dimensional shape with a surface enclosing an inner volume, wherein the surface comprises a first part directed outwardly of the three-dimensional shape and a second part being the lateral area of a cylindrically shaped hole protruding through the flavoring device,
- and a frame arranged at the surface of the three-dimensional shape and framing the inner volume at least in part, wherein the flavoring material is arranged within the frame, wherein the frame and the flavoring material are permeable to an air flow directed from a surrounding of the flavoring device through the first part of the surface, through the inner volume, thereby interacting with the flavoring material, and through the second part of the surface into the hole, wherein the flavoring device comprises the shape of a hollow cylinder having airflow permeable inner and outer lateral areas, is arranged around the smoking article, wherein the flavoring device is positioned on the mouthpiece covering the air intake openings.

By positioning the flavoring device on the mouthpiece covering the air intake openings, fluid communication between the second part of the surface of the flavoring device and the air intake openings is established. In this way, the air flow from flavoring device is directed into the smoking article through the air intake openings. As previously explained, the airflow unites in the mouthpiece of the smoking article with the mainstream flow path carrying the smoke and/or vapor. In this way, the air flavored by interaction with the flavoring material in the flavoring device is mixed with the smoke and/or vapor of the smoking article thereby creating a flavored smoke and/or vapor and is then delivered to the consumer. As also previously explained, the consumer can freely decide if and when to position the flavoring device on the smoking article and choose a flavoring device comprising the desired flavor. In this way, the smoke and/or vapor of the smoking article can be flavored in a most individual way.

BRIEF DESCRIPTION OF THE DRAWINGS

Further advantages, objectives and features of the present invention will be described, by way of example only, in the following description with reference to the appended figures. In the figures, like components in different embodiments can exhibit the same reference symbols.

The figures show.

DETAILED DESCRIPTION

Figure 1:
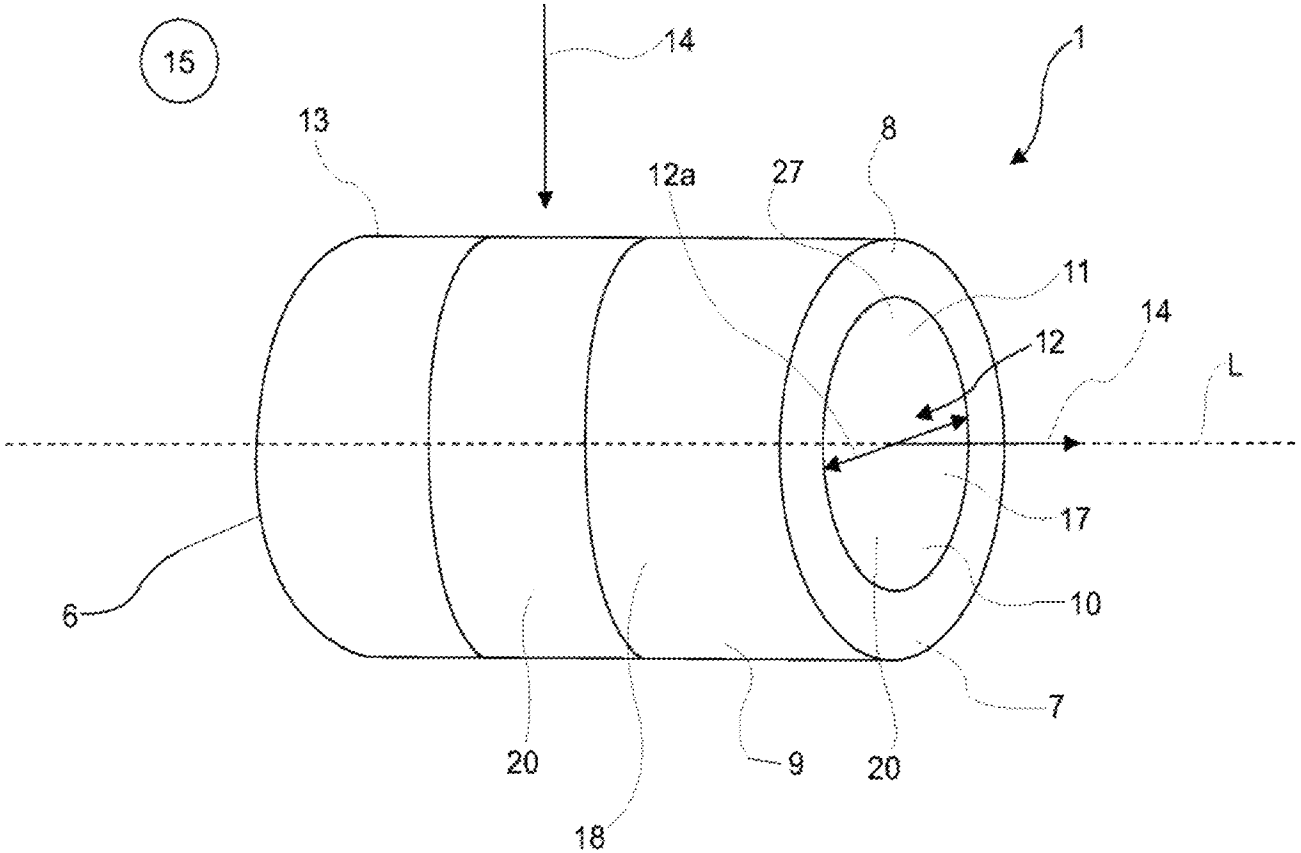
FIG. 1 a perspective view of the flavoring device 1.

FIG. 1 shows the flavoring device 1 in a perspective view. The flavoring device 1 comprises a three-dimensional (3D-shape) 6. The 3D-shape 6 comprises a surface 7, which encloses an inner volume 8. The flavoring device 1 comprises a cylindrically shaped hole 12, which pro-trudes completely through the flavoring device 1 having a longitudinal axis L. In other words, the flavoring device 1 comprises a circular shaped channel 12 running along the longitudinal axis L. The surface 7 of the flavoring device 1 comprises two parts 9, 10. A first part 9 of the surface 7 is directed outwardly of the 3D-shape 6, i.e. towards a surrounding 15 of the flavoring device 1. A second part 10 of the surface 7 denotes the lateral area 11 of the cylindrically shape hole 12. The diameter 12*a* of the hole is defined by the diameter 26 of the base area 27 of the cylindrically shaped hole 12.

The 3D shape 6 is a ring 6. In other words, the 3D shape 6 is a hollow cylinder 6. This hollow cylinder 6 comprises an inner lateral area 17, which is the same area as the lateral area 11 of the cylindrically shaped hole 12 and denotes the second part 10 of the surface 7. Furthermore, the hollow cylinder 6 also comprises an outer lateral area 18. The outer lateral area 18 is part of the first part 9 of the surface 7 and is directed towards the surrounding 15 of the flavoring device 1.

The flavoring device 1 comprises a frame 13. The frame 13 stabilizes the flavoring device 1 mechanically. The frame 13 surrounds the inner volume 8 at least in part. In the inner volume 8 and in the frame 13 a flavoring material 5 is arranged. The flavoring material 5 can deliver a flavor to an air flow 14 passing through the flavoring material 5. The surface 7 of the flavoring device 1 comprises air-permeable parts 20. In the air-permeable parts 20 an air flow 14 can pass through the surface 7 of the flavoring device 1. The first part 9 of the surface 7 comprises at least one air-permeable part 20. The second part 10 of the surface 7 comprises at least one air-permeable part 20. This implies that the frame 13 is permeable to an airflow 14. However, the frame 13 is not necessarily air-permeable in its entirety. Preferably, only parts of the frame 13 are air-permeable thereby denoting the air-permeable parts 20. Due to the air-permeability of the frame 13, an airflow 14 can pass from a surrounding 15 of the flavoring device through the first part 9 of the surface 7 into the inner volume 8. The flavoring material 5 arranged in the inner volume 8 is also air-permeable. The air flow 14 passes through the flavoring material 5 thereby interacting with it. During the interaction flavor is transferred from the flavoring material to the air of the air flow 14 passing through the flavoring material 5. From there the air flow 14 passes through the second part 10 of the surface 7 into the hole 12. In this way an air flow 14 directed from the surrounding 15 of the flavoring device 1 through the first part 9 of the surface 7, through the inner volume 8, thereby interacting with the flavoring material 5, and through the second part 10 of the surface 7 can flow into the hole 12, in which a smoking article 4 is arrangeable.

Figure 2:
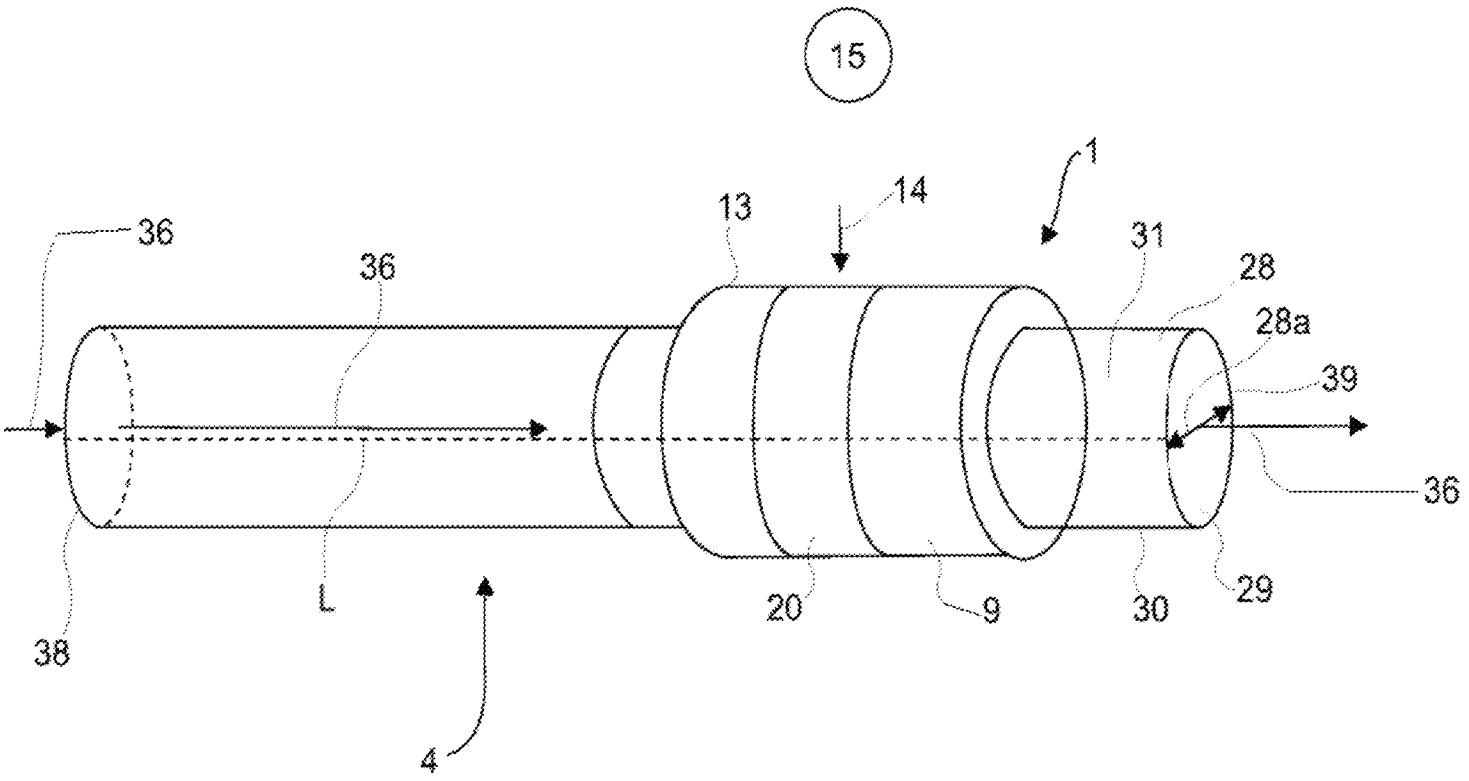
FIG. 2 a schematic view of the flavoring device 1 arranged at a smoking article 4.

FIG. 2 shows a schematic view of the flavoring device 1 arranged at a smoking article 4. The smoking article 4 is arranged with its mouthpiece 28 in the hole 12 of the flavoring device 1. The appropriate fitting of a smoking article 4 in the hole 12 is secured by the diameter 12*a* of the hole 12 corresponding to the diameter 28*a* of the mouthpiece 28. Corresponding means in this context that the diameter 12*a* of the hole 12 can be slightly smaller or larger than the diameter 28*a* of the mouthpiece 28. The exact size of the diameter 12*a* of the hole 12 depends on the chosen material combination of flavoring device 1 and mouthpiece 28 and is selected to ensure a secure fit of the flavoring device 1 on the mouthpiece 28. Preferably, the diameter 12*a* of the hole 12 equals the diameter 28*a* of the mouthpiece 28.

With the arrangement of the smoking article 4 in the hole 12, the air flow 14 is now directed from the surrounding 15 of the flavoring device 1 through the first part 9 of the surface 7, through the inner volume 8, thereby interacting with the flavoring material 5, and through the second part 10 of the surface 7 towards the smoking articles 4 mouthpiece 28. The mouthpiece 28 comprises ventilation holes 32 (not shown in FIG. 2 as they are covered by the flavoring device 1). The ventilation holes 32 allow a secondary flow path 37 from the surrounding 15 through the ventilation holes 32 into the mouthpiece 28 in addition to the primary flow path 36 of the smoking article. The primary flow path 36 is the flow path of the smoke 2 and/or vapor 3. In case of a conventional cigarette, this primary flow path 36 is directed from a lit end 38 of the smoking article along its longitudinal axis L towards a mouth end 39. In the mouthpiece 28 the primary and secondary flow paths 36, 37 join and leave the smoking article together at the mouth end 39.

Figure 3:
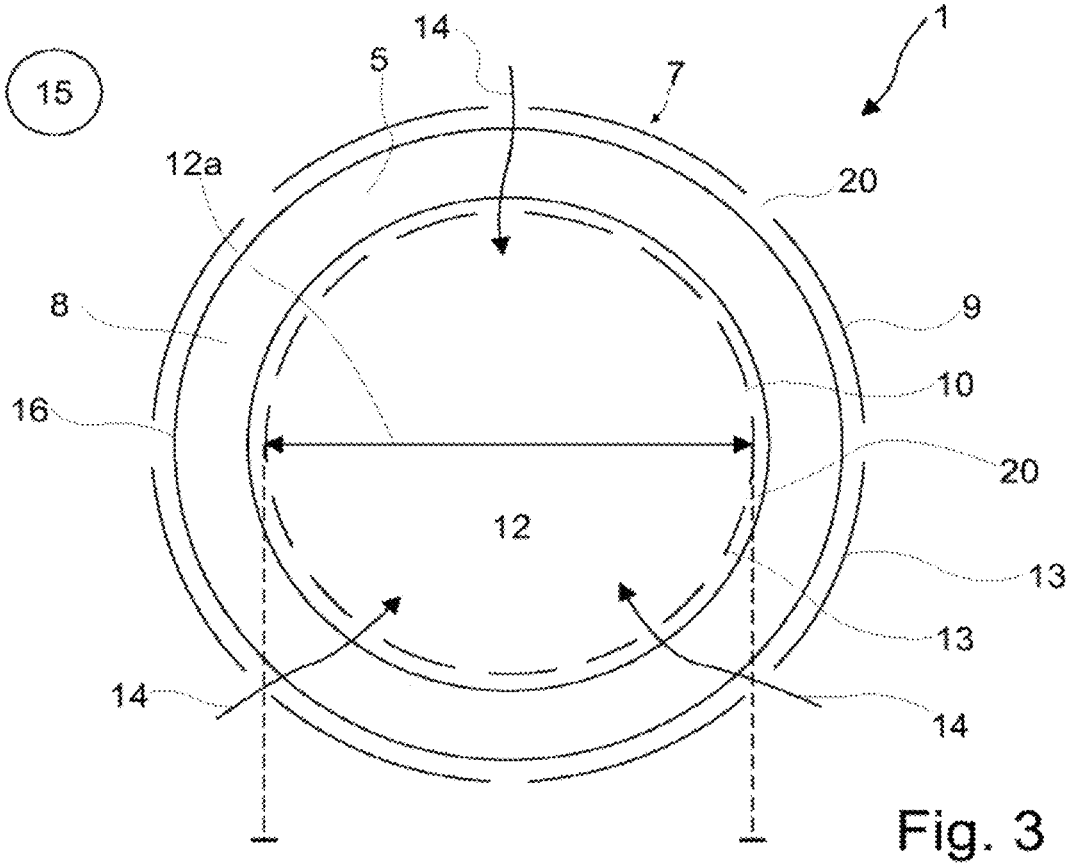
FIG. 3 a sectional view of the flavoring device 1.

FIG. 3 shows a sectional view of the flavoring device 1 parallel to the base area 20 and perpendicular to the lateral area 11 shown in FIG. 1. The ring shape of the flavoring device 1 of this embodiment can directly be seen. The first part 9 and the second part 10 of the surface 7 are concentric circles in this cross-section. The represent the frame 13. Between the first and second part 9, 10, i.e. in the frame 13, the flavoring material 5 is arranged. For better visibility the flavoring material 5 is shown slightly smaller, so it can be visually distinguished from the surface 7 and the frame 13. However in reality flavoring material 5 and frame 13 would be in direct contact. The first and second parts 9, 10 comprise airflow permeable parts 20. The air flow 14 can pass through the airflow permeable parts 20 and thus pass the first and second parts 9, 10 of the surface 7 and the flavoring material 5 arranged in between. The air flow 14 is directed from a surrounding through in inner volume 8 in to the hole 12 along the way passing the first and second parts 9, 10 of the surface 7 through the air-permeable parts 20. In other words, the airflow 14 is directed from outside of the ring-shaped flavoring device 1 through the inner volume 8 of the ring-shaped flavoring device into the volume encircled by the ring-shaped flavoring device 1, i.e. the hole 12.

Figure 4:
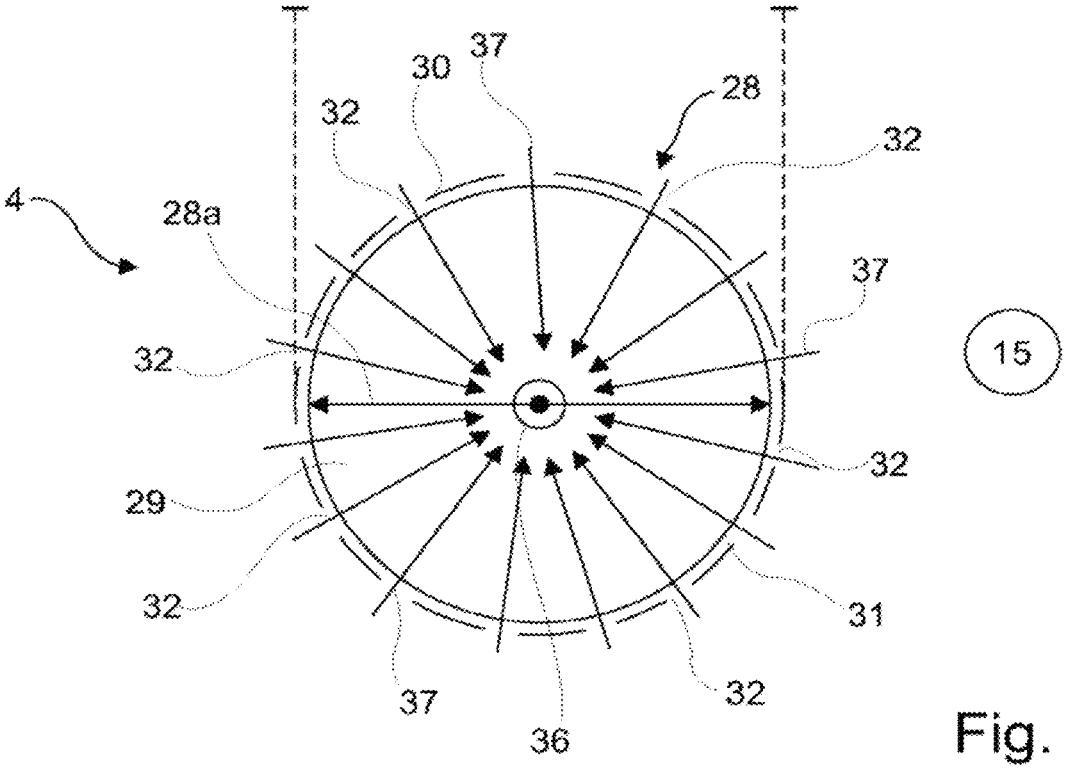
FIG. 4 a sectional view of the smoking articles 4 mouthpiece 28.

FIG. 4 shows a sectional view of the smoking articles 4 mouthpiece 28 parallel to the base area 20 and perpendicular to the longitudinal axis L shown in FIG. 2. The mouthpiece comprises a filter 29 and a wrapper 30. The wrapper 30 is wrapped circumferentially around the lateral area 31 of the cylindrically shaped filter 29. For better visibility the filter 29 is shown slightly smaller than the wrapper 30 so they can be visually distinguished. However in reality they would be in direct contact. The wrapper comprises ventilation holes 32. The ventilation holes 32 denote through holes through the wrapper. The ventilation holes 32 enable a secondary flow path 37 from a surrounding 15 of the smoking article 1 through the ventilation holes 32 into the filter 29. The filter 29 is air-permeable. In the filter 29, the secondary flow path 37 unites with the primary flow path 36 carrying the smoke 2 and/or vapor 3.

A synopsis of FIGS. 3 and 4 clarifies the relation of the diameters 12*a* and 28*a*. The diameter 12*a* of the hole 12 equals the diameter 28*a* of the mouthpiece 28. As standard filter 29 materials are typically compressible, the equality of the diameters 12*a* and 28*a* ensures a tight fit of the mouthpiece 28 in the hole 12. Preferably, the diameter 12*a* of the hole 12 is 24.6 mm.

Figure 5:
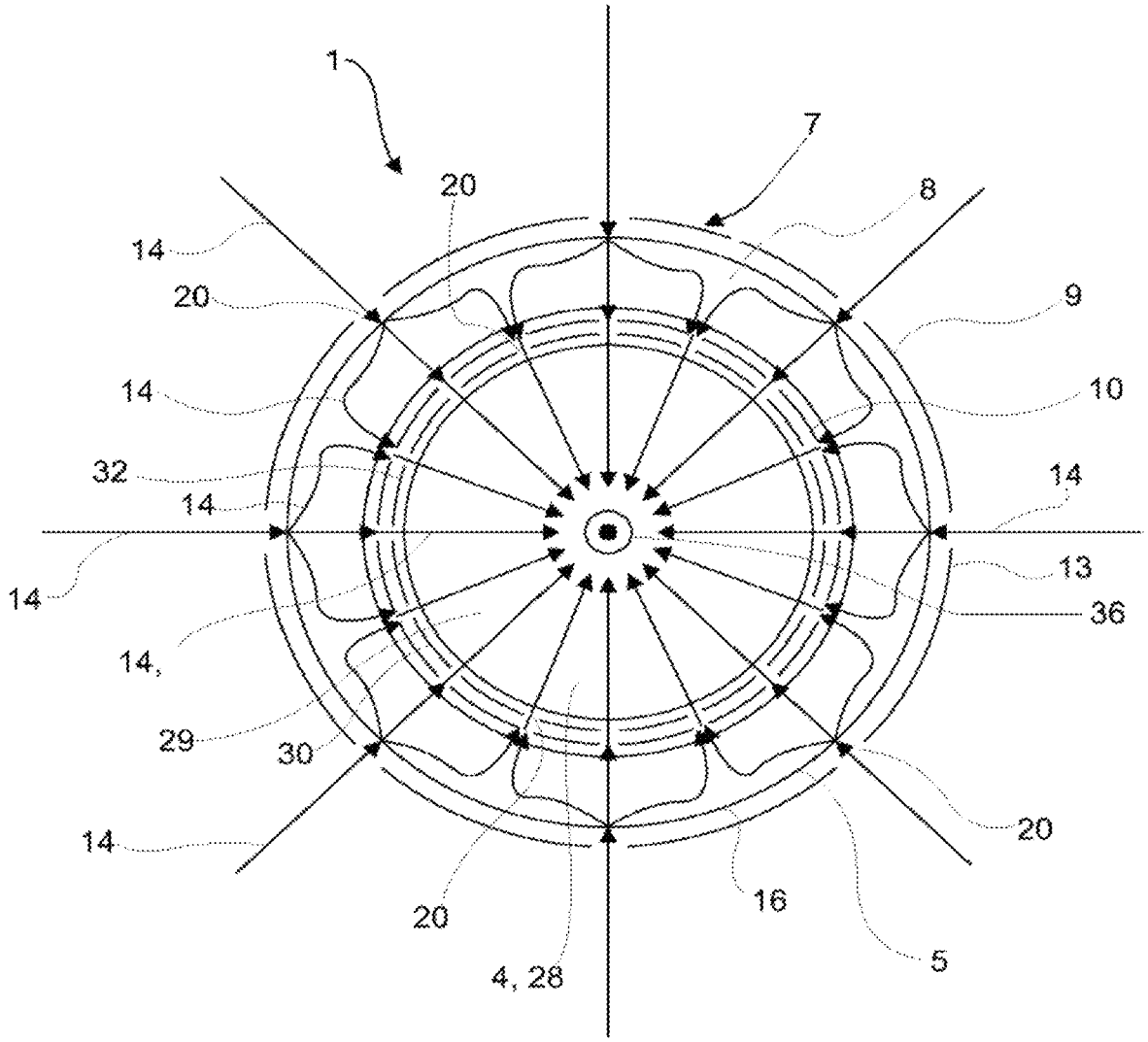
FIG. 5 a sectional view of the flavoring device 1 and the smoking articles 4 mouthpiece 28 combined.

FIG. 5 shows the flavoring device 1 of FIG. 3 and the smoking articles 4 mouthpiece 28 of FIG. 4 combined. The mouthpiece 28 is arranged in the hole 12 of the flavoring device 1. For better visibility the mouthpiece 28 is shown slightly smaller, so the wrapper 30 can be visually distinguished from the second part 10 of the surface 7. However in reality they would be in direct contact.

The airflow 14 enters the flavoring device 1 from a surrounding 15 through air-permeable parts 20 in the first part 9 of the surface 7 into the inner volume 8 of the frame 13. The airflow 14 then passes through the flavoring material 5 arranged in the inner volume 8 of the flavoring device 1 thereby interacting with the flavoring material 5. The air flow 14 then passes through air-permeable parts 20 in the second part 10 of the surface 7 out of the flavoring device 1. At this point, the air flow 14 has reached the hole 12, in which the mouthpiece 28 of the smoking article 4 is arranged. The airflow 14 now enters the smoking articles 4 mouthpiece 28 through the ventilation holes 32 and further proceeds along the secondary flow path 37 towards the primary flow path 36 with which it unites upon reaching it.

In this way, a flavored smoke 2 and/or vapor 3 is supplied in the primary flow path 36 of the smoking article 4.

Figure 6:
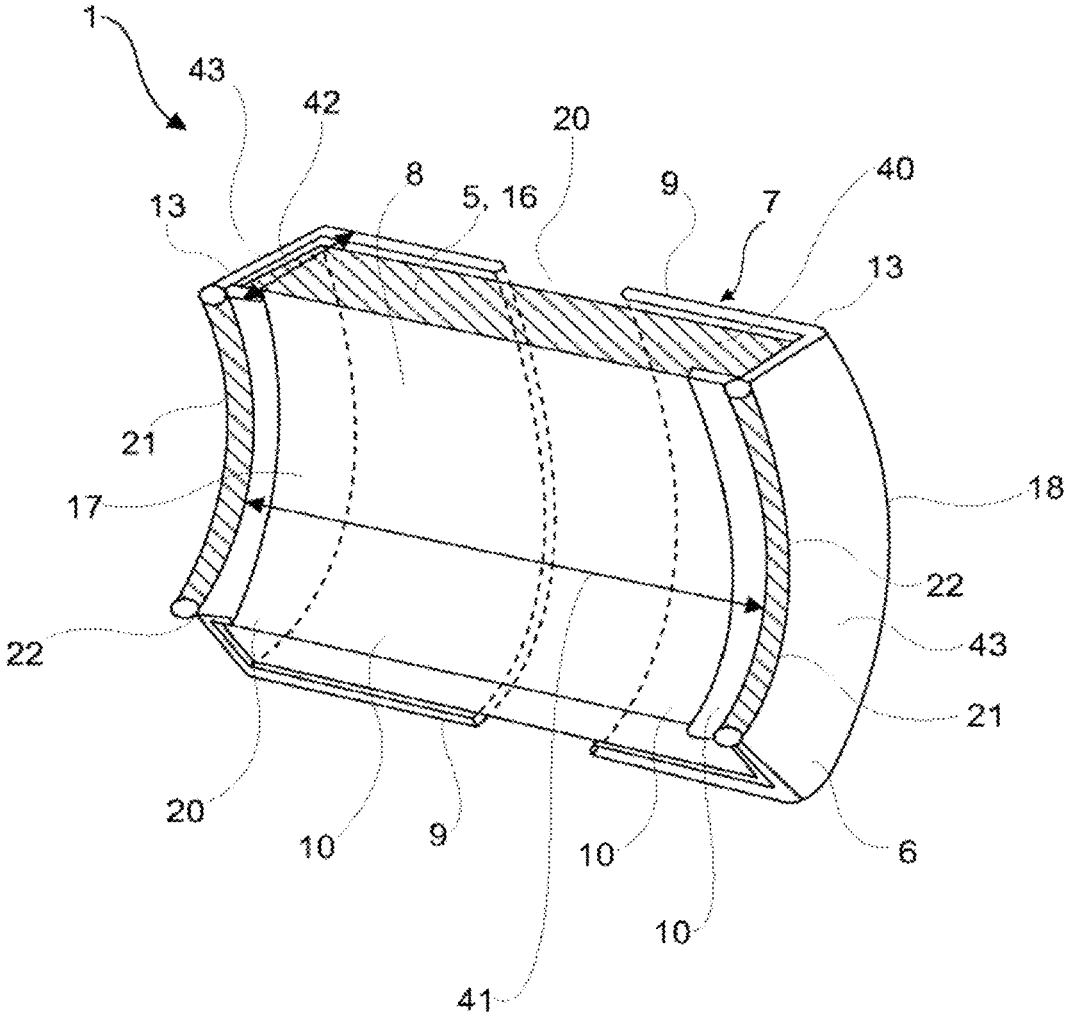
FIG. 6 a segment of the flavoring device 1 in a perspective view.
Figure 7A:
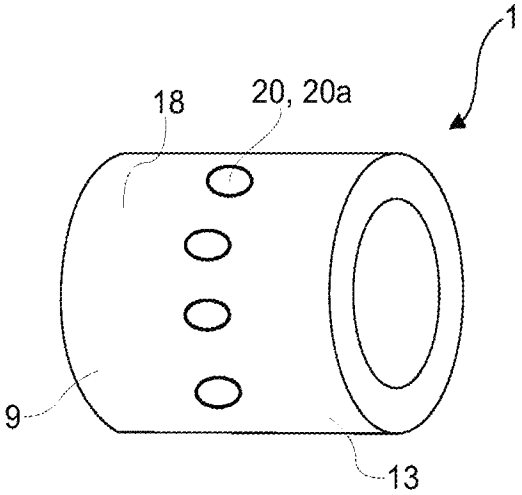
FIG. 7 a-d different embodiments of the flavoring device 1 with different airflow permeable parts 20.
Figure 7B:
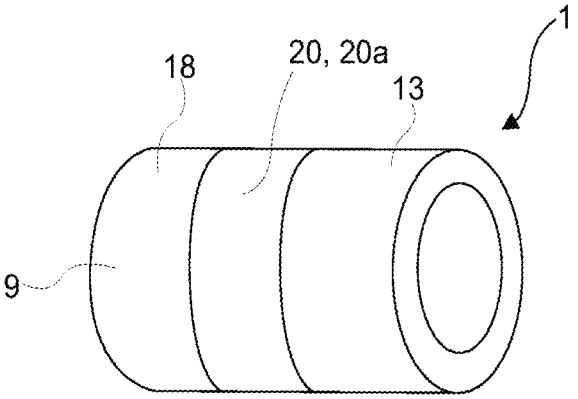
Figure 7C:
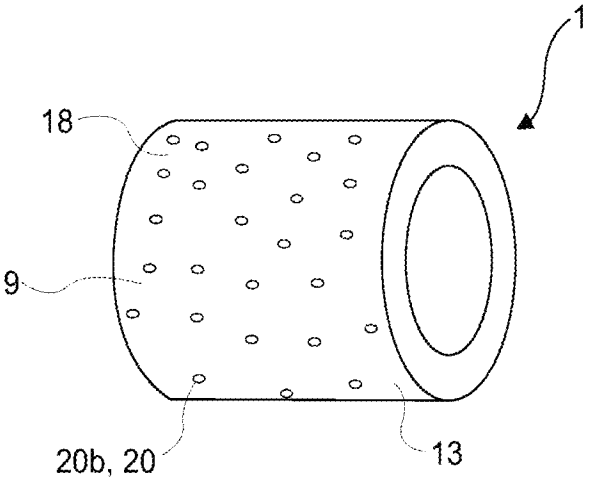
Figure 7D:
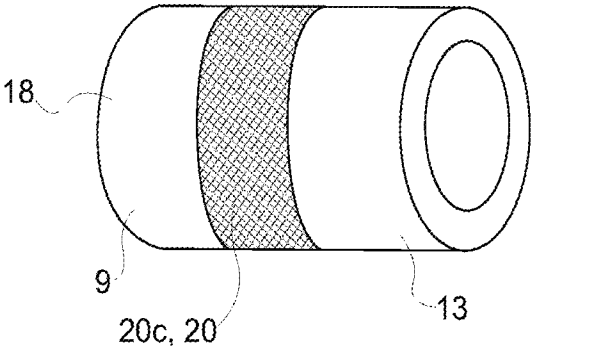

FIG. 6 shows a segment of the flavoring device 1 in a perspective view. The previously described rectangular cross section 40 of the flavoring device 1 in the embodiment of a hollow cylinder cut perpendicular to the surface 7 becomes clearly visible. The inner volume 8, in which the flavoring material 5, preferably comprised in a carrier material 16, is arranged, is framed by a frame 13. Together they form the 3D-shape 6 of the flavoring device 1 with its surface 7. The rectangular cross section 40 comprises a longer side 41 and a shorter side 42. The longer side 41 is preferably between 5 and 10 mm long, even more preferred between 7 and 9 mm. The longer side 41 corresponds to the length of the flavoring device 1 along the longitudinal axis L (please cf. FIG. 1). The shorter side 42 is preferably between 3 and 7 mm long, even more preferred between 4 and 6 mm. The shorter side 42 corresponds to a thick-ness of the flavoring device 1 measured radially from the inner lateral area 17 to the outer lateral area 18 (also please cf. FIG. 1).

The frame 13 encloses the inner volume 8 at least in part. In part means, that the frame does not cover the inner volume 8 completely but leaves out air-permeable parts 20. The hollow cylinder shape of the flavoring device 1 comprises an inner lateral area 17, an outer lateral area 18 and ring-shaped base areas 43. Preferably, the frame 13 fully covers the base areas 43 and the inner and outer lateral areas 17, 18 at least in part. Preferably, the flavoring device 1 comprises two gaskets 21 circumferentially arranged at the edges 22 on the inner lateral area 17.

FIGS. 7 a-d show different embodiments of the flavoring device 1 with different airflow permeable parts 20. The different airflow permeable parts 20 are shown as air-permeable parts 20 of the outer lateral area 18, which is in the first part 9 of the surface 7 of the flavoring device 1. However, all the shown embodiments of the air-permeable parts 20 are also applicable to the inner lateral area 17, i.e. the second part 10 of the surface. For the second part 10 of the surface 7 either the same or different embodiments of the air-permeable parts 20 can be used. FIG. 7*a* shows air-permeable parts 20 realized as cut-outs 20*a*. Preferably, the cut-outs 20*a* are arranged circumferentially on the outer lateral area 18. Preferably, the cut-outs 20*a* comprise a round shape. FIG. 7*b* shows air-permeable parts 20 realized as one single cut-out 20*a*. In this embodiment, the single cut-out 20*a* is shaped as a circumferential stripe. FIG. 7*c* shows air-permeable parts 20 realized as a perforation 20*b*. The whole outer lateral area 18 can be perforated, or only certain parts of this area. For example could only the area corresponding to the circumferential cut-out 20*a* of FIG. 7*b* be perforated. FIG. 7*d* shows air-permeable parts 20 realized as a net-like structure 20*c*. In this embodiment, a circumferential cut-out 20*a* is covered with a net material being air-permeable. In this way, the air-permeability is ensured whereas the flavoring material 5 itself or the carrier material 16 is stopped from falling out of the inner volume 8 of the flavoring material 1 through the air-permeable part 20.

Figure 8A:
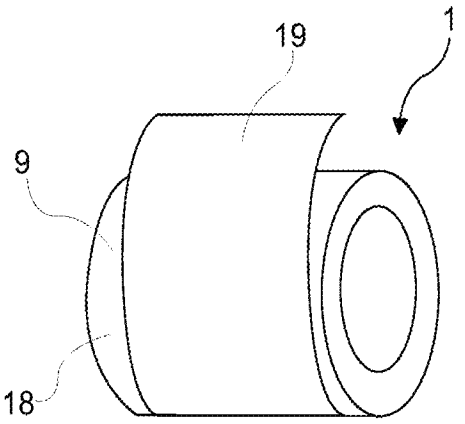
FIG. 8 a,b a flavoring device 1 with a peel-off strip 19 (FIG. 8*a*) and the flavoring device 1 after removal of the pee-off strip 19 (FIG. 8*b*)
Figure 8B:
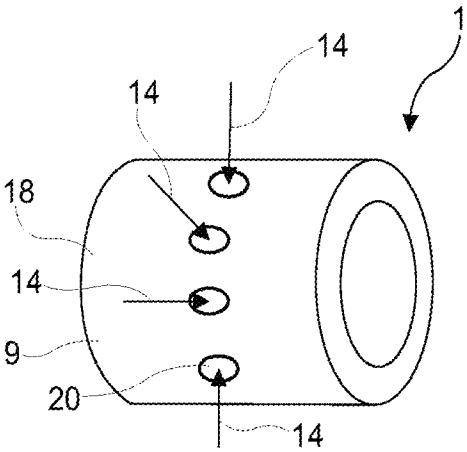

FIGS. 8*a* and *b* show a flavoring device 1 with a peel-off strip 19 (FIG. 8*a*) and the flavoring device 1 after removal of the peel-off strip 19 (FIG. 8*b*). The peel-off strip 19 is circumferentially wrapped around the first part 9 of the surface 7. In particular, the peel-off strip 19 is circumferentially wrapped around the outer lateral area 18. The peel-off strip 19 covers all air-permeable parts 20 of the first part 9 of the surface 7. In this way, the peel-off strip 19 prohibits the air flow 14 through the air-permeable parts 20 of the first part 9 of the surface 7. After removal of the peel-off strip 19, the air-permeable parts 20 of the first part 9 of the surface 7 are no longer covered and the air flow through the air-permeable parts 20 is enabled.

Figure 9A:
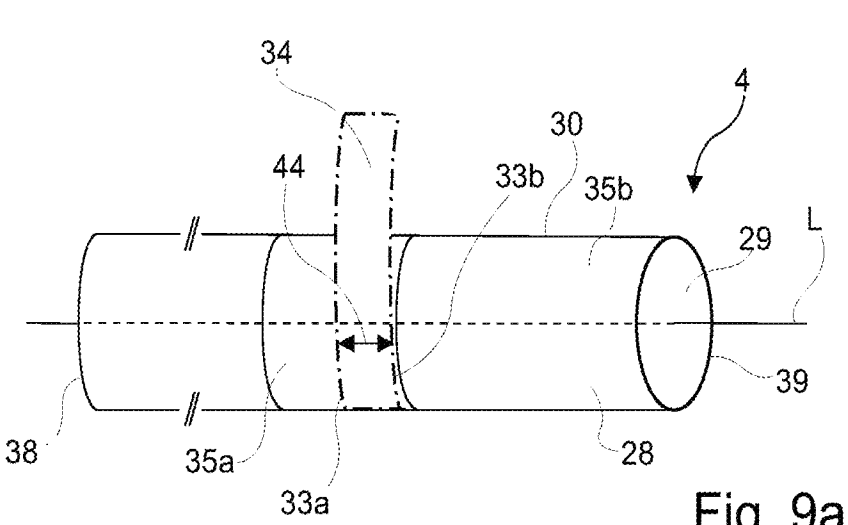
FIG. 9 a,b a smoking article 4 with a removable first part 34 of the wrapper 30 (FIG. 9*a*) and the smoking article 4 after removal of the first part 34 of the wrapper 30 (FIG. 9*b*)
Figure 9B:
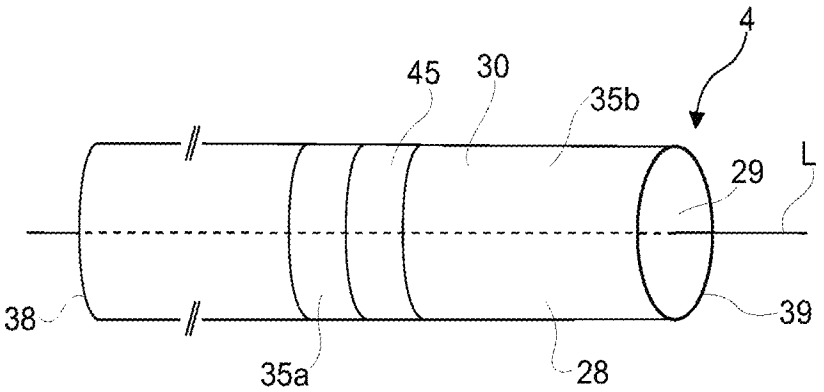

FIGS. 9*a* and *b* show a smoking article 4 with a removable first part 34 of the wrapper 30 (FIG. 9*a*) and the smoking article 4 after removal of the first part 34 of the wrapper 30 (FIG. 9*b*). The wrapper 30 of the smoking articles 4 mouthpiece 28 comprises two circumferential perforation lines 33*a, b*. The two perforation lines 33*a, b* are distanced from each other along the longitudinal axis L of the smoking article 4. Preferably, the distance 44 between the perforation lines 33*a, b* is equal or smaller than the length of the flavoring device 1 along the longitudinal axis. Between the perforation lines 33*a, b* a first part 34 of the wrapper is arranged. The first part 34 can be removed from the mouthpiece 28 by tearing of the perforation lines 33*a,b*. The first part 34 of the wrapper 30 is removed similar to a peel-off strip. After removal of the first part 34, the mouthpiece 28 comprises a remaining second part 35 of the wrapper 30. The second part 35 is divided into two parts 35*a,b* by a gap 45. In the gap 45 is no wrapper 30. The filter 29 is uncovered in the gap 45. The flavoring device 1 can now be positioned covering the gap 45. In this way, the airflow 14 leaving the air-permeable parts 20 of the second part 10 of the surface 7 does not need to pass any ventilation holes 32 but can directly access the filter 29.

Figure 10:
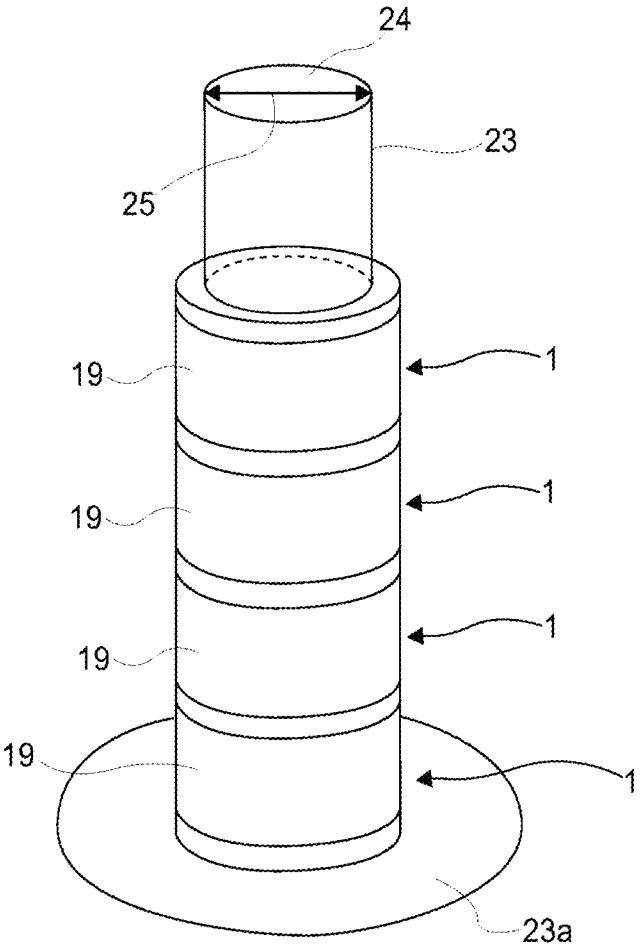
FIG. 10 a schematic view of the removable holder 23 with flavoring devices 1 arranged thereon

FIG. 10 shows a schematic view of the removable holder 23 with flavoring devices 1 arranged thereon. The removable holder 23 comprises a circular cross section 24. The diameter of the cross section 24 preferably equals the diameter 28*a* of a smoking articles 4 mouthpiece 28. Preferably, the removable holder 23 comprises a stopper base plate 23*a* on one end of the removable holder. The flavoring articles 1 can be mounted on the removable holder 23. Preferably, they are rested against the base plate 23*a* and mounted or demounted from the removable holder 23 from the removable holders 23 end opposing the base plate 23*a*. The removable holder 23 covers the air-permeable parts 20 of the second part 10 of the surface 7 of the flavoring articles 1 mounted on the removable holder 23, thereby prohibiting any airflow 14 through the air-permeable parts 20 of the second part 10. Preferably, the flavoring devices 1 also comprise a peel-off strip 19. Together with the removable holder 23 the peel-off strip 19 prohibits any air flow 14 in or out of the inner volume 8 of the flavoring device mounted on the removable holder 23.

The applicant reserves his right to claim all features disclosed in the application document as being an essential feature of the invention, as long as they are new, individually or in combination, in view of the prior art. Furthermore, it is noted that in the figures features are described, which can be advantageous individually. Someone skilled in the art will directly recognize that a specific feature being disclosed in a figure can be advantageous also without the adoption of further features from this figure. Furthermore, someone skilled in the art will recognize that advantages can evolve from a combination of diverse features being disclosed in one or vari-ous figures.

LIST OF REFERENCE SYMBOLS

1 flavoring device
2 smoke
3 vapor
4 smoking article
5 flavoring material

6 three-dimensional (3D) shape
7 surface
8 inner volume
9 first part of surface
10 second part of surface
11 lateral area
12 hole
12*a* diameter
13 frame
14 airflow
15 surrounding
16 carrier material
17 inner lateral area
18 outer lateral area
19 peel-off strip
20 airflow permeable parts
20*a* cut-outs
20*b* perforations
20*c* net-like structure
21 gasket
22 edge
23 removable holder
23*a* base plate
24 cross-section
25 diameter of cross-section
26 diameter of base area
27 base area
28 mouth piece
28*a* diameter
29 filter
30 wrapper
31 lateral area
32 air intake openings, ventilation holes
33*a, b* perforation lines
34 first part of wrapper
35 second part of wrapper
36 primary flow path
37 secondary flow path
38 lit end
39 mouth end
40 rectangular cross section
41 longer side
42 shorter side
43 base area
44 distance
45 gap
L longitudinal axis

The invention claimed is:

1. A flavoring device, in particular for flavoring a fluid stream, such as a smoke and/or vapor of a smoking article, wherein the flavoring device comprises a three-dimensional shape with a surface enclosing an inner volume, wherein the surface comprises a first part having an airflow permeable outer lateral area directed outwardly of the three-dimensional shape and a second part being an airflow permeable inner lateral area of a cylindrically shaped hole protruding through the flavoring device, wherein the flavoring device comprises a frame arranged at the surface of the three-dimensional shape and framing the inner volume at least in part, wherein a flavoring material is arranged within the frame, wherein the frame and the flavoring material are permeable to an air flow directed from a surrounding of the flavoring device through the first part of the surface, through the inner volume, thereby interacting with the flavoring material, and through the second part of the surface into the hole, in which a smoking article is arrangeable, wherein the flavoring device comprises a shape of a hollow cylinder.

2. The flavoring device according to claim 1, wherein in the inner volume a carrier material is arranged in which the flavoring material is contained.

3. The flavoring device according to claim 2, wherein the carrier material includes clay, zeolite, cellulose, cellulose acetate, cotton, granule and/or gel.

4. The flavoring device according to claim 1, wherein a diameter of a base area of the cylindrically shaped hole equals a diameter of a mouth piece of a smoking article.

5. The flavoring device according to claim 1, wherein the first and second parts of the surface comprise cut-outs, perforations and/or are netlike at least in part.

6. The flavoring device according to claim 1, wherein the frame includes cellulose acetate, at least one biodegradable polymer, wood, cork, clay and/or zeolite.

7. The flavoring device according to claim 1, wherein the flavoring material includes a solid material, a crystal, a granule, a gel and/or a liquid.

8. The flavoring device according to claim 1, further comprising a peel-off strip covering at least all airflow-permeable parts of the first part of the surface.

9. The flavoring device according to claim 8, wherein the peel-off strip comprises paper and/or cellulose.

10. The flavoring device according to claim 1, further comprising a gasket at edges of the second part of surface.

11. The flavoring device according to claim 1, further comprising a removable holder made of non-porous material comprising a circular cross section with a diameter corresponding to a diameter of a base area of the cylindrically shaped hole, with the removable holder arranged protruding through the hole.

12. The flavoring device according to claim 11, wherein the removable holder is in a stick form.

13. A kit comprising a smoking article and the flavoring device according to claim 1, wherein the flavoring device is placed on a mouth piece of the smoking article with the mouth piece arranged protruding through the hole, wherein the mouth piece comprises air intake openings and the flavoring device is placed over the air intake openings with the second part of the surface, and an air flow of the flavoring device is configured to be in fluid communication with a smoke and/or vapor through the air intake openings.

14. The kit according to claim 13, wherein the smoking article further comprises a wrapper with two circumferential perforation lines distanced from each other along a longitudinal axis, wherein a circumferential first part of the wrapper enclosed between the perforation lines is removable from the mouth piece with respect to a second part of the wrapper.

15. A method for flavoring smoke and/or vapor of a smoking article comprising a mouthpiece, with air intake openings, wherein a flavoring device comprising:

a three-dimensional shape with a surface enclosing an inner volume, wherein the surface comprises a first part having an airflow permeable outer lateral area directed outwardly of the three-dimensional shape and a second part being an airflow permeable inner lateral area of a cylindrically shaped hole protruding through the flavoring device, and a frame arranged at the surface of the three-dimensional shape and framing the inner volume at least in part, wherein the flavoring material is arranged within the frame, wherein the frame and the flavoring material are permeable to an air flow directed from a surrounding of the flavoring device through the first part of the surface, through the inner volume, thereby interacting with the flavoring material, and through the second part of the surface into the hole, wherein the flavoring device comprises a shape of a hollow cylinder, is arranged around the smoking article, wherein the flavoring device is positioned on the mouth piece covering the air intake openings.

* * * * *